US009128422B2

(12) United States Patent
Yashiro et al.

(10) Patent No.: US 9,128,422 B2
(45) Date of Patent: Sep. 8, 2015

(54) IMAGE FORMING APPARATUS AND IMAGE FORMING METHOD

(71) Applicants: Akira Yashiro, Osaka (JP); Takayuki Kawamoto, Osaka (JP); Kunihiro Komai, Osaka (JP)

(72) Inventors: Akira Yashiro, Osaka (JP); Takayuki Kawamoto, Osaka (JP); Kunihiro Komai, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/208,131

(22) Filed: Mar. 13, 2014

(65) Prior Publication Data

US 2014/0270864 A1 Sep. 18, 2014

(30) Foreign Application Priority Data

Mar. 15, 2013 (JP) ..... 2013-054435
Jan. 20, 2014 (JP) ..... 2014-007969

(51) Int. Cl.
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/1605; G03G 15/1665; G03G 15/167; G03G 15/1675; G03G 15/657
See application file for complete search history.

(56) References Cited

U.S. PATENT DOCUMENTS

| | | | | |
|---|---|---|---|---|
| 4,095,206 | A * | 6/1978 | Hishiki | 336/96 |
| 7,689,153 | B2 * | 3/2010 | Nakagawa et al. | 399/306 |
| 2007/0104502 | A1 * | 5/2007 | Ogihara et al. | 399/66 |
| 2011/0103850 | A1 * | 5/2011 | Watanabe et al. | 399/315 |
| 2012/0315058 | A1 * | 12/2012 | Shimizu et al. | 399/66 |
| 2012/0321332 | A1 * | 12/2012 | Yanagi et al. | 399/66 |
| 2013/0016989 | A1 * | 1/2013 | Fujita et al. | 399/88 |
| 2014/0119763 | A1 * | 5/2014 | Yamaura et al. | 399/71 |

FOREIGN PATENT DOCUMENTS

| | | |
|---|---|---|
| JP | 11-024443 | 1/1999 |
| JP | 2002-318494 | 10/2002 |
| JP | 2006-156719 | 6/2006 |
| JP | 2009-122168 | 6/2009 |
| JP | 2011-007907 | 1/2011 |

* cited by examiner

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

An aspect of the present invention provides an image forming apparatus including: a photosensitive element where a latent image is formed and developed into a toner image; an image carrier; an intermediate transfer driving roller that drives the image carrier; a primary transfer roller for transferring the toner image from the photosensitive element to the image carrier; a secondary transfer roller for secondary transfer of the toner image from the image carrier to a medium; a bias applying unit that applies, as a secondary transfer bias, a first bias and a second bias to the intermediate transfer driving roller and the secondary transfer roller, respectively; and a fixing unit that fixes the toner image onto the medium. The first bias is lower than a minimum voltage at which discharge to the primary transfer roller can occur. The second bias depends on the first bias and is opposite in polarity therefrom.

5 Claims, 5 Drawing Sheets

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2013-054435 filed in Japan on Mar. 15, 2013 and Japanese Patent Application No. 2014-007969 filed in Japan on Jan. 20, 2014.

BACKGROUND OF THE INVENTION

1. Field of the Invention

The present invention relates generally to image forming apparatuses and image forming methods.

2. Description of the Related Art

In an image forming apparatus, a bias opposite in polarity to a bias necessary for printing is typically applied to perform cleaning. There is a known technique for obtaining such a cleaning bias without a circuit dedicated only for this purpose by applying biases of a same polarity output from a single transformer to rollers facing each other. An example of such a technique is disclosed in Japanese Laid-open Patent Publication No. 2009-122168.

An image forming apparatus disclosed in Japanese Laid-open Patent Publication No. 2009-122168 performs image formation by: forming a toner image by causing toner to stick to an electrostatic latent image on a photosensitive element; transferring the toner image onto an image carrier using a primary transfer roller; performing secondary transfer of transferring the toner image from the image carrier onto a medium, such as paper, using a secondary transfer roller; and fixing the toner image onto the medium. Secondary transfer biases that allow supplying a required amount (or value) of electric current for the secondary transfer are applied to the image carrier and the secondary transfer roller.

Japanese Laid-open Patent Publication No. 2009-122168 also discloses another example, in which secondary transfer biases that are opposite in polarity are applied to the facing rollers.

In an image forming apparatus that employs an intermediate transfer system, toner is caused to stick to electrostatic latent images on one or more photosensitive elements (e.g., four photosensitive elements for yellow, magenta, cyan and black or a single photosensitive element for shared use among yellow, magenta, cyan, and black) for respective employed colors. The toner images are temporarily transferred onto another image carrier (e.g., a transfer belt). The transferred toner images are transferred a second time (hereinafter, "secondary transfer") onto a to-be-printed medium (hereinafter, "medium"), such as paper.

The secondary transfer is performed by applying an electrical charge that exerts an attractive force or a repulsive force to a charge of the toner, thereby transferring the toner image from the transfer belt onto the medium.

For instance, in a case where the toner is negatively charged, a secondary transfer bias (negative bias) may be applied to an intermediate transfer driving roller so that a repulsive force transfers the toner image from the transfer belt to paper. Alternatively, a secondary transfer bias (positive bias) may be applied to the secondary transfer roller so that an attractive force transfers the toner image from the transfer belt onto paper.

Because the toner image is transferred by action of the charge, it is necessary to supply a predetermined value of electric current. The required amount of charges (i.e., the value of electric current) depends on an amount of the toner (more specifically, an image to be printed). For this reason, a scheme that transfers toner from a photosensitive element to a transfer belt by applying a constant voltage bias is adopted by a number of example configurations. In this scheme, application of a desired value of electric current is achieved by changing the value of electric current in accordance with an image to be printed. As for transfer of toner from a transfer belt to a medium such as paper, a value of electric current that varies with a change in electrical resistance, which depends on a type and water absorption of paper, is larger than a value of electric current that varies in accordance with an image to be printed. For this reason, a scheme that applies a constant current bias and achieves application of a desired electric current by correcting the value of electric current in accordance with an image to be printed is employed for the secondary transfer in a number of example configurations.

Meanwhile, an image forming apparatus has the following structural characteristic. A front surface, to which toner is to be transferred, of a medium such as paper has more pathways, e.g., a neutralizing brush, through which electric current flows than a back surface of the medium. Accordingly, electric discharge is more likely to occur on the front surface. For this reason, applying a secondary transfer bias to an intermediate transfer driving roller is generally considered as being advantageous.

In a case where an excessive amount of electric current should flow (discharge) though a medium such as paper, a voltage drop can result in a defective image or activation of a protective circuit in the image forming apparatus. Activation of the protective circuit in the image forming apparatus is equivalent to detection of an error, whereby operation of the image forming apparatus is stopped.

Meanwhile, in a small-size image forming apparatus, a distance between an intermediate transfer driving roller and a photosensitive element is small. Accordingly, when a secondary transfer bias is applied to the intermediate transfer driving roller, the applied bias can disadvantageously discharge to a nearby primary transfer roller.

The applied bias can discharge to a nearby photosensitive element; also in that case, a voltage drop can result in a defective image or activation of a protective circuit in the image forming apparatus. Activation of the protective circuit is equivalent to detection of an error, whereby operation of the image forming apparatus is stopped.

In the technique disclosed in Japanese Laid-open Patent Publication No. 2009-122168, the secondary transfer bias is applied to the secondary transfer roller side to avoid such a disadvantageous situation that the applied bias discharges to a nearby photosensitive element or a nearby primary transfer roller, with the knowledge that this configuration provides a disadvantage.

The disadvantage of the image forming apparatus according to Japanese Laid-open Patent Publication No. 2009-122168 is that the secondary transfer bias is likely to discharge or discharges through a medium such as paper.

In the light of the circumstances, there is a need for providing an image forming apparatus and an image forming method that can prevent or reduce discharge of a secondary transfer bias through a medium such as paper.

It is an object of the present invention to at least partially solve the problem in the conventional technology.

SUMMARY OF THE INVENTION

It is an object of the present invention to at least partially solve the problems in the conventional technology.

According to the present invention, there is provided An image forming apparatus comprising: a photosensitive element, on which an electrostatic latent image is to be formed; an image carrier, onto which a toner image formed by causing toner to stick to the electrostatic latent image is to be transferred; an intermediate transfer driving roller that drives the image carrier; a primary transfer roller for transferring the toner image from the photosensitive element to the image carrier; a secondary transfer roller for performing secondary transfer of transferring the toner image from the image carrier to a medium; a bias applying unit that applies a secondary transfer bias necessary for the secondary transfer by applying a first bias and a second bias to the intermediate transfer driving roller and the secondary transfer roller, respectively, the first bias being lower than a minimum voltage at which discharge from the image carrier to the primary transfer roller can occur, the second bias being a voltage that is opposite in polarity from the first bias and that depends on the first bias; and a fixing unit that fixes the toner image onto the medium, onto which the toner image has been transferred.

The present invention also provides an image forming method comprising: forming an electrostatic latent image on a photosensitive element; forming a toner image formed by causing toner to stick to the electrostatic latent image; transferring the toner image from the photosensitive element to the image carrier using a primary transfer roller; applying a secondary transfer bias necessary for secondary transfer by applying a first bias and a second bias to an intermediate transfer driving roller and a secondary transfer roller, respectively, the first bias being lower than a minimum voltage at which discharge from the image carrier to the primary transfer roller can occur, the second bias being a voltage that is opposite in polarity from the first bias and that depends on the first bias; and performing the secondary transfer of transferring the toner image from the photosensitive element to the image carrier using the secondary transfer roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
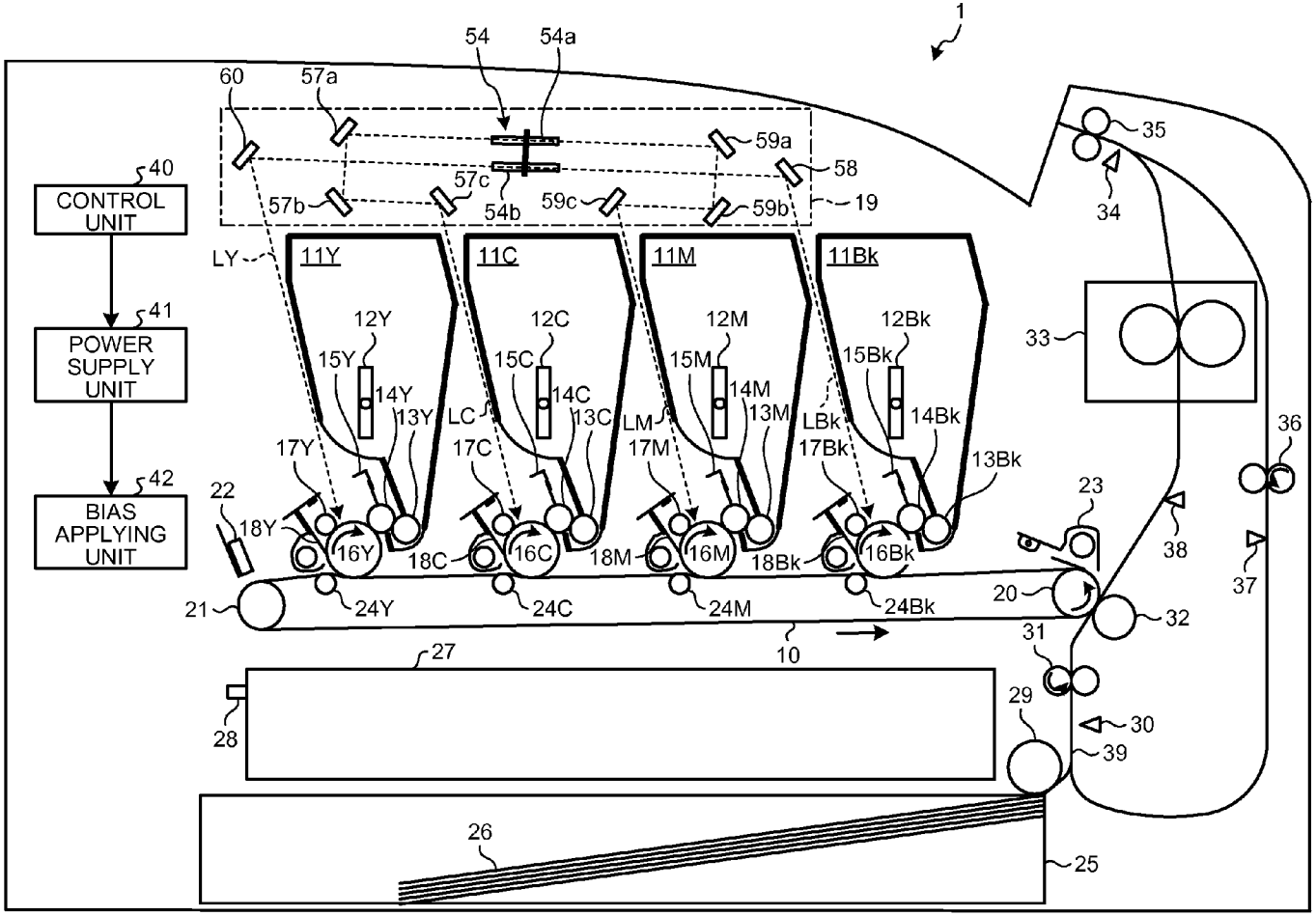
FIG. 1 is a schematic diagram illustrating an example configuration of an image forming apparatus according to an embodiment of the present invention.

FIG. 1 is a schematic diagram illustrating an example configuration of an image forming apparatus according to an embodiment of the present invention. As illustrated in FIG. 1, an image forming apparatus 1 according to this embodiment is configured as what is referred to as a tandem image forming apparatus, in which all-in-one cartridges (hereinafter, "cartridges") 11Bk, 11M, 11C, and 11Y serving as electrophotographic processing units for black (Bk), magenta (M), cyan (C), and yellow (Y) are arranged along a transfer belt 10.

The endless transfer belt 10 revolves counterclockwise in FIG. 1. The cartridges 11Bk, 11M, 11C, and 11Y are arranged in this order along the revolving direction of the transfer belt 10 in a manner to face an outer circumferential surface of the transfer belt 10. The cartridge 11Bk forms a black image; the cartridge 11M forms a magenta image; the cartridge 11C forms a cyan image; the cartridge 11Y forms a yellow image. The plurality of cartridges 11Bk, 11M, 11C, and 11Y are identical in internal configuration except the color of the toner image to be formed. Hereinafter, portions common to the cartridges 11Bk, 11M, 11C, and 11Y are denoted by like reference numbers and mainly described by way of an example of the cartridge 11Bk, omitting repeated description about the other cartridges 11M, 11C, and 11Y.

The transfer belt 10 is looped around and supported by an intermediate transfer driving roller 20, which is a driving roller to be driven to rotate, and a transfer-belt tension roller 21, which is a driven roller. The intermediate transfer driving roller 20 is driven to rotate by a drive motor (not shown). The drive motor, the intermediate transfer driving roller 20, and the transfer-belt tension roller 21 correspond to a rotary mechanism (moving mechanism) that causes the transfer belt 10 to revolve. In this embodiment, a registration mark sensor 22 and a transfer belt cleaner 23 are arranged facing the outer circumferential surface of the transfer belt 10.

The cartridge 11Bk includes a paddle 12Bk, a photosensitive element 16Bk, a charging device 17Bk, a developing device 14Bk, a supply roller 13Bk, a developing blade 15Bk, and a cleaner blade 18Bk. The paddle 12Bk agitates toner. The charging device 17Bk is arranged on a periphery of the photosensitive element 16Bk. The supply roller 13Bk supplies the toner to the developing device 14Bk.

The exposing device 19 is a unit that writes image data to a surface of the photosensitive element as a group of points of light by raster scanning the surface with laser light. The exposing device 19 emits laser light LBk for black, laser light LM for magenta, laser light LC for cyan, and laser light LY for yellow, which are exposure lights respectively corresponding to the colors of images to be formed by the cartridges 11Bk, 11M, 11C, and 11Y.

The exposing device 19 includes a polygon mirror 54. The polygon mirror 54 is rotated by a polygon mirror motor (not shown) at a constant rotation speed in a fixed rotating direction. The rotation speed depends on a rotation speed of the photosensitive element, a write speed, the number of facets on the polygon mirror 54, and the like.

The laser light LBk from a black light source unit and the laser light LY from a yellow light source unit are incident on lower side surfaces 54*b* of the polygon mirror 54 and deflected by rotation of the polygon mirror 54. Each of the laser lights passes through one of fθ lenses (not shown) and is then re-directed by a first mirror 58 or 60 to illuminate the photosensitive element 16Bk or 16Y for exposure. The laser light LM from a magenta light source unit and the laser light LC from a cyan light source unit are incident on upper side surfaces 54*a* of the polygon mirror 54 and deflected by rotation of the polygon mirror 54. Each of the laser lights passes through one of the fθ lenses (not shown) and is then re-directed by second mirrors 57*a*, 57*b*, and 57*c* or 59*a*, 59*b*, and 59*c* to illuminate the photosensitive element 16M or 16C for exposure.

In an image forming operation, the outer circumferential surface of the photosensitive element 16Bk is uniformly charged by the charging device 17Bk in darkness. Thereafter, the outer circumferential surface is exposed to the laser light LBk representing a black image emitted from the exposing device 19. Thus, an electrostatic latent image is formed on the outer circumferential surface of the photosensitive element 16Bk. The developing device 14Bk develops the electrostatic latent image with black toner into a visible image. A black toner image is thus formed on the photosensitive element 16Bk. The toner image is transferred at a position (primary transfer position) where the photosensitive element 16Bk contacts the transfer belt 10 onto the transfer belt 10 with help of a primary transfer roller 24Bk. The black toner image is formed on the transfer belt 10 in this manner.

After the toner image has been transferred from the photosensitive element 16Bk, the cleaner blade 18Bk wipes off unnecessary toner that remains on the outer circumferential surface of the photosensitive element 16Bk. Thereafter, the photosensitive element 16Bk is placed on standby for next image formation. The waste toner is conveyed to a waste toner bin 27. When a waste-toner full sensor 28 detects full, the waste toner bin 27 is replaced with another piece of the waste toner bin 27.

A portion, to which the black toner image is transferred by the cartridge 11Bk, of the transfer belt 10 is moved to a position where the portion faces the immediately downstream cartridge 11M as the transfer belt 10 revolves. A magenta toner image is transferred to be superimposed on the black toner image through a process similar to that described above. The portion, to which the black toner image and the magenta toner image are transferred as being superimposed, of the transfer belt 10 is moved to a position where the portion faces the cartridge 11C and then to a position where the portion faces the cartridge 11Y. A cyan toner image and a yellow toner image are respectively transferred to the portion as being superimposed. A full-color image is formed on the transfer belt 10 by superimposing in this way. The portion where the full-color superimposed image is formed of the transfer belt 10 is moved to a position where the portion faces a secondary transfer roller 32.

Meanwhile, when only a black image is to be printed, primary transfer rollers 24M, 24C, and 24Y for the other colors retreat to positions away from the photosensitive elements 16M, 16C, and 16Y, respectively. Thereby, the image forming process described above is performed only for black.

A sheet of a medium (hereinafter, "sheet") 26 is conveyed as follows. A sheet feeding roller 29 is driven to rotate counterclockwise, causing an uppermost one of the sheets 26 housed in a sheet feed tray 25 to be delivered onto a sheet pathway 39. Timing to stop rotation of the sheet feeding roller 29 is controlled based on an output from a sensor 30 that detects the sheet 26. Accordingly, the sheet 26 can be placed on standby at a position of a registration roller 31. Subsequently, the sheet feeding roller 29 and the registration roller 31 are driven to rotate to deliver the sheet 26 forward with timing adjusted to overlay the toner image and the sheet 26 on one another on the secondary transfer roller 32. Rotations of the sheet feeding roller 29 and the registration roller 31 are stopped when an output from the sensor 30 indicates that the sheet 26 is not detected any more.

The toner image on the transfer belt 10 is transferred onto the sheet 26 delivered by the registration roller 31 at the position of the secondary transfer roller 32. A neutralizing brush of a neutralizing unit 38 neutralizes a residual charge on the sheet 26, onto which the toner image has been transferred from the transfer belt 10 at the position of the secondary transfer roller 32. Thereafter, the toner image is fixed onto the sheet 26 by heat and pressure in a fixing device 33. The sheet 26 is output to the exterior of the image forming apparatus 1 by a sheet output roller 35 that is driven to rotate.

When duplex printing is to be performed, the sheet output roller 35 is stopped and then driven to rotate counterclockwise immediately after a trailing end of the sheet 26 has passed by a sheet output sensor 34. As a result, the sheet 26 is conveyed to a duplex-printing conveyance path arranged at a right position in FIG. 1. The sheet 26 conveyed to the duplex-printing conveyance path is conveyed to the registration roller 31 on the sheet pathway 39 again via a duplex-printing roller 36.

The secondary transfer roller 32 transfers a toner image to the sheet 26 on the side opposite from the side where the toner image has already been transferred. The toner image is then fixed onto the sheet 26 by heat and pressure in the fixing device 33. The sheet 26 is output to the exterior of the image forming apparatus 1 by the sheet output roller 35 that is driven to rotate clockwise. A timing instant when the sheet 26 has passed by the duplex-printing roller 36 is detected by a duplex-printing sensor 37.

A control unit 40 constructed from electrical components (not shown), such as circuit elements mounted on a circuit board, is housed in a casing of the image forming apparatus 1. The control unit 40 is implemented on a microcomputer including a central processing unit (CPU), a read only memory (ROM), and a random access memory (RAM). The control unit 40 controls the entire image forming apparatus 1 and executes bias-voltage application control according to this embodiment.

A power supply unit 41 supplies electric power to units of the image forming apparatus 1. The power supply unit 41 supplies electric power to a bias applying unit 42 under control of the control unit 40. The bias applying unit 42 outputs bias voltages to be applied to units including the charging device 17Bk, 17M, 17C, 17Y, the photosensitive elements 16Bk, 16M, 16C, 16Y, the intermediate transfer driving roller 20, and the secondary transfer roller 32.

The control unit 40 synchronizes the number of rotations of the polygon mirror 54 to a single line to be formed on each of the photosensitive elements 16Bk, 16M, 16C, 16Y according to a start-synchronization detection signal generated based on a detection result output from a synchronization sensor (not shown). This operation, by which one line of an image is formed, is repeatedly performed to form an entire single image on each of the photosensitive elements 16Bk, 16M, 16C, 16Y.

The bias applying unit 42 outputs bias voltages to the units, such as the intermediate transfer driving roller 20 and the secondary transfer roller 32, that require bias application in the image forming apparatus 1.

The bias applying unit 42 applies a secondary transfer bias, which is a bias necessary for secondary transfer, as follows.

The bias applying unit 42 applies a voltage, or a first bias, of a level that will not cause the voltage to discharge to a nearby primary transfer roller to the intermediate transfer driving roller 20. The first bias is opposite in polarity from a voltage, or a second bias, applied to the secondary transfer roller 32. The bias applying unit 42 applies the second bias that is opposite in polarity from the first bias applied to the intermediate transfer driving roller 20 to the secondary transfer roller 32 to supply a fixed value of electric current. The value of the second bias is determined by subtracting the first bias applied to the intermediate transfer driving roller 20 from a voltage that needs to be applied for the secondary transfer. Applying the biases in this manner reduces the second bias applied to the secondary transfer roller 32 while applying the secondary transfer bias necessary for the secondary transfer (supplying the necessary amount, or value, of electric current), thereby preventing or reducing discharge of the secondary transfer bias through a medium such as paper.

Furthermore, reduction in the discharge through a medium such as paper leads to reduction in the value of electric current that needs to be supplied. Still furthermore, applying the first bias and the second bias to the intermediate transfer driving roller 20 and the secondary transfer roller 32, respectively, leads to reduction in the applied bias per roller. As a result, downscaling of a circuit of the power supply unit 41, in particular reduction in transformer size, can be achieved.

Bias Application Examples

Figure 2:
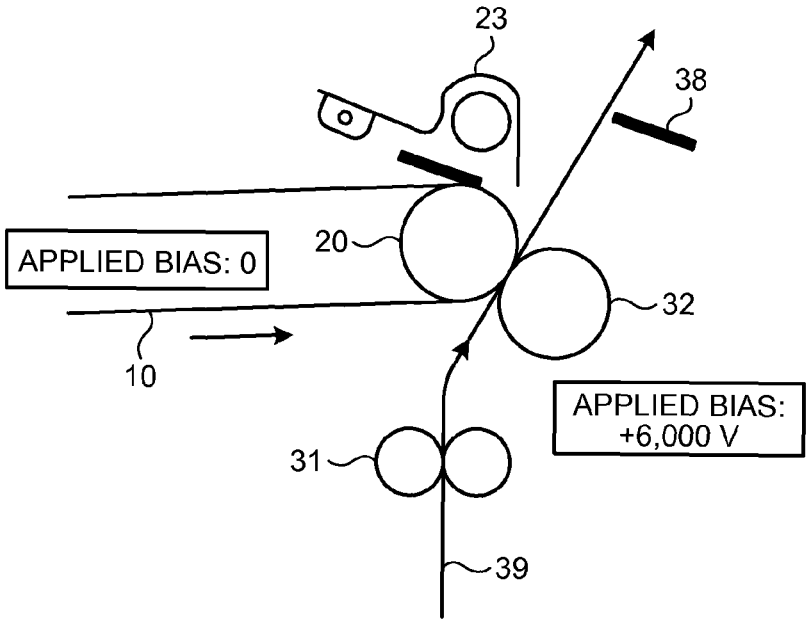
FIG. 2 is a diagram illustrating an example, in which a bias is applied only to a secondary transfer roller.

First, an example, in which a bias is applied only to the secondary transfer roller 32, is described below. FIG. 2 illustrates an example, in which a bias applied to the intermediate transfer driving roller 20 is zero (0 V), while the bias applied to the secondary transfer roller 32 is "+6,000 V". In short, a secondary transfer bias is applied only to the secondary transfer roller 32 in the example illustrated in FIG. 2. The potential difference between the intermediate transfer driving roller 20 and the secondary transfer roller 32 is "6,000 V".

To prevent or reduce discharge of the secondary transfer bias through a medium such as paper, it is desirable to reduce the second bias, or the secondary transfer bias, (which is "+6,000V" in the example illustrated in FIG. 2) applied to the secondary transfer roller 32. Accordingly, in this embodiment, the second bias applied to the secondary transfer roller 32 is reduced, and the first bias that is opposite in polarity from the first bias and of a value compensating for the reduced bias is applied to the intermediate transfer driving roller 20. However, when a bias is applied also to the intermediate transfer driving roller 20, the applied bias can discharge to a nearby primary transfer roller or the like as described above.

For instance, when the image forming apparatus 1 is small in size, the distance between the intermediate transfer driving roller 20 and the photosensitive element 16Bk or the like will be small. For this reason, when a voltage that allows supplying the value of electric current necessary for the secondary transfer (transferring toner from the transfer belt 10 to a medium) is applied to the intermediate transfer driving roller 20, the applied bias undesirably discharges to the nearby transfer roller 24Bk or the like.

Meanwhile, it is known that such discharge will not occur so long as the value of the applied bias is lower than a certain value of voltage. To make use of this, in this embodiment, a maximum value of bias that will not cause such discharge is calculated, and a bias equal to or lower than the calculated bias is applied to the intermediate transfer driving roller 20.

The voltage that allows supplying the value of electric current necessary for the secondary transfer is the potential difference between the transfer belt 10 and a medium. If the first bias is applied to the intermediate transfer driving roller 20, the voltage that needs to be applied to the secondary transfer roller 32 to achieve the necessary potential difference can be reduced by the applied first bias voltage. As a result, discharge of a secondary transfer bias through a medium such as paper can be prevented or reduced.

Possible methods for determining the first bias to be applied to the intermediate transfer driving roller 20 include the following method. The method includes: experimentally setting a maximum value of voltage, at which discharge to the primary transfer roller 24Bk or the like does not occur, or a maximum value of voltage, at which an amount of discharge is lower than an allowable level for image formation, in advance; and determining the first bias based on the preset voltage. The possible methods also include determining the first bias to be applied to the intermediate transfer driving roller 20 based on an environmental condition. Examples of the environmental condition include a temperature, a humidity, deterioration with time, and an atmospheric pressure.

It is generally necessary to use a sealed-type transformer to apply a high voltage (e.g., "+6,000 V") as in the example illustrated in FIG. 2. This is because an open-type transformer is generally usable only in applying a relatively low voltage. In this embodiment, because the first bias and second bias that are opposite in polarity are applied to the intermediate transfer driving roller 20 and the secondary transfer roller 32, respectively, the applied bias per roller can be of a relatively small value. This makes it possible to employ open-type transformers.

Figure 3:
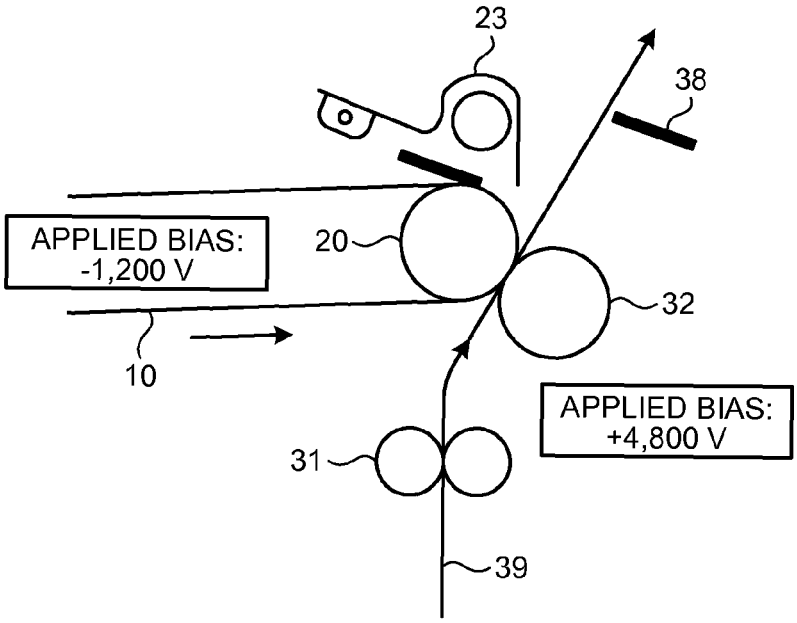
FIG. 3 is a diagram illustrating an example, in which biases are applied to the secondary transfer roller and an intermediate transfer driving roller, respectively.

FIG. 3 is a diagram illustrating an example, in which biases are applied respectively to the intermediate transfer driving roller 20 and the secondary transfer roller 32. In the example illustrated in FIG. 3, the first bias applied to the intermediate transfer driving roller 20 is "−1,200 V"; the second bias applied to the secondary transfer roller 32 is "+4,800 V". Also in this example, the difference between the bias applied to the intermediate transfer driving roller 20 and the bias applied to the secondary transfer roller 32 is +4,800−(−1,200)=6,000 (V). In other words, in the example illustrated in FIG. 3, the potential difference between the intermediate transfer driving roller 20 and the secondary transfer roller 32 is "6,000 V", which is the same as that of the example illustrated in FIG. 2. However, in contrast to the example illustrated in FIG. 2, the second bias applied to the secondary transfer roller 32 is "+4,800 V" in the example illustrated in FIG. 3. Thus, reduction in the applied bias by "1,200 V" is achieved.

This reduction leads prevention of or reduction in discharge of the secondary transfer bias through a medium such as paper. Furthermore, the example illustrated in FIG. 3, an open-type transformer can be used to apply the "+4,800 V" bias. An open-type transformer can also be used to apply the "−1,200 V" bias.

As described above, according to this embodiment, downsizing of the power supply unit 41 in the image forming apparatus 1 can be achieved by reducing the bias to be applied to the secondary transfer roller 32. More specifically, by virtue of reduction in discharge through a medium such as paper, the value of electric current that needs to be supplied is reduced. Furthermore, applying the first and second biases to the intermediate transfer driving roller 20 and the secondary transfer roller 32, respectively, reduces the applied bias per roller. As a result, the power supply unit 41 can employ transformers that output smaller voltages. In particular, the size of the transformers included in the power supply unit 41 can be reduced. For example, if a bias to be applied is approximately "5,000 V" or lower in absolute value, it becomes possible to employ an open-type transformer that is small in size and less expensive.

In the example illustrated in FIG. 3, it will be preferable that the first bias is applied to the intermediate transfer driving roller 20 with any one of a configuration that maintains the value of applied electric current constant and a configuration that maintains the applied voltage constant; the second bias is applied to the secondary transfer roller 32 with the other one of the configurations. If the first bias is applied to the intermediate transfer driving roller 20 with the configuration that maintains the applied voltage constant, the voltage becomes less susceptible to a change in resistance resulting from a change in external environment. Accordingly, it becomes possible to control the voltage so as not to discharge to the nearby primary transfer roller 24Bk or the like. Consequently, the value of the first bias, at which discharge from the intermediate transfer driving roller 20 to the nearby primary transfer roller 24Bk will not occur, can be set free from the influence of a change in the resistance resulting from a change in the external environment.

Meanwhile, keeping the applied voltage at 0 V is equivalent to grounding (connecting to GND). In the configuration that maintains the voltage of one of the applied biases constant and maintains the value of electric current of the other applied bias constant, the side where the applied voltage is maintained constant can be viewed as being grounded (connected to GND) from the side where the value of applied electric current is maintained constant. In other words, the configuration is substantially equivalent to a configuration in which one of the sides maintains the value of applied electric current constant, and the other side is grounded, the other side is grounded (connected to GND). Accordingly, the voltage to be applied to the secondary transfer roller 32 can be reduced.

Figure 4:
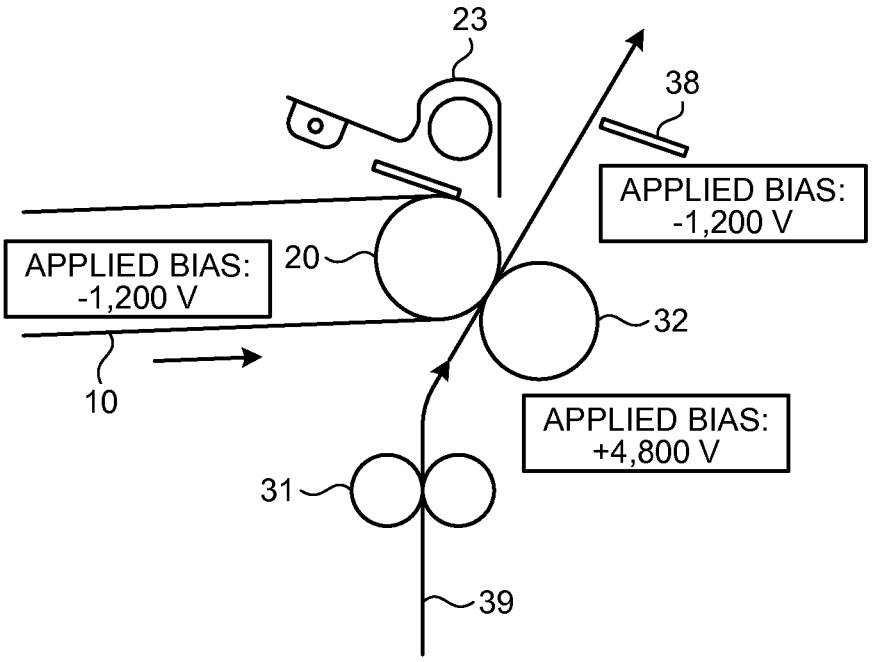
FIG. 4 is a diagram illustrating an example, in which a bias is applied also to a neutralizing brush.

FIG. 4 is a diagram illustrating an example, in which biases are applied to the intermediate transfer driving roller 20 and the secondary transfer roller 32, respectively. In the example illustrated in FIG. 4, the first bias applied to the intermediate transfer driving roller 20 is "−1,200 V"; the second bias applied to the secondary transfer roller 32 is "+4,800 V" as in the example illustrated in FIG. 3. Also in this example, the difference between the bias applied to the intermediate transfer driving roller 20 and the bias applied to the secondary transfer roller 32 is +4,800−(−1,200)=6,000 (V).

In the example illustrated in FIG. 4, a bias voltage is applied also to the neutralizing brush, which is the neutralizing unit 38, in addition to the biases applied in the example illustrated in FIG. 3. In the example illustrated in FIG. 4, "−1,200 V", which is the same as the first bias applied to the intermediate transfer driving roller 20, is applied to the neutralizing unit 38. This bias application makes the potential difference between the neutralizing unit 38 and the secondary transfer roller 32 of the configuration that applies the secondary transfer bias to both the secondary transfer roller 32 and the intermediate transfer driving roller 20 to be equal to that of the configuration that applies the secondary transfer bias only to the secondary transfer roller 32. Accordingly, even when the bias applied to the secondary transfer roller 32 is reduced, a neutralization effect can be maintained.

Meanwhile, there can be employed a configuration, in which the same bias voltage as that of the first bias applied to the intermediate transfer driving roller 20 is applied to the neutralizing unit 38. This can be achieved by branch-connecting wiring for applying the bias to the neutralizing unit 38 to wiring (not shown) for applying the first bias. This configuration eliminates the need for providing discrete power supplies.

In the example illustrated in FIG. 4, the value of the bias applied to the neutralizing unit 38 is the same as the value of the first bias applied to the intermediate transfer driving roller 20. However, the applied biases may differ from each other as required.

Bias Applying Unit

Figure 5:
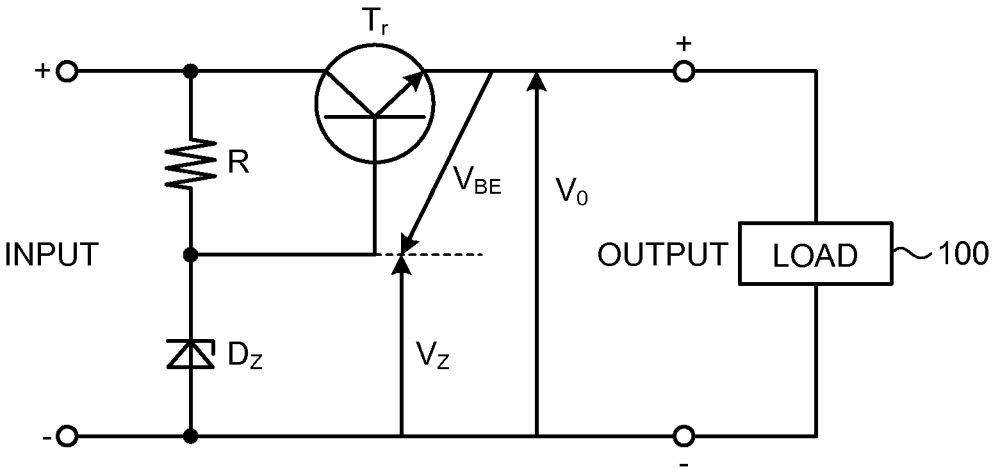
FIG. 5 is a diagram illustrating an example configuration of a circuit that maintains an applied voltage constant.

FIG. 5 is a diagram illustrating an example configuration of a constant voltage regulator circuit (hereinafter, "voltage regulator circuit") for maintaining the applied voltage constant. The voltage regulator circuit is included in the bias applying unit 42. The voltage regulator circuit illustrated in FIG. 5 includes a bipolar transistor $T_r$, a Zener diode $D_z$, and a resistor R. A load 100 in FIG. 5 can be, for instance, the intermediate transfer driving roller 20 illustrated in FIGS. 1 to 4. The positive input terminal of the voltage regulator circuit is connected to the collector of the bipolar transistor $T_r$; the positive output terminal of the voltage regulator circuit is connected to the emitter of the bipolar transistor $T_r$. The Zener diode D, and the resistor R are connected in series between the negative input terminal and the positive input terminal of the voltage regulator circuit. The base of the bipolar transistor $T_r$ is connected to a junction between the resistor R and the Zener diode $D_z$. This configuration maintains the base of the bipolar transistor $T_r$ at a Zener voltage $V_z$.

Referring to FIG. 5, when an output voltage $V_o$ of the voltage regulator circuit decreases, a base-emitter voltage $V_{BE}$ of the bipolar transistor $T_r$ increases, increasing an output current (collector current), and rising the output voltage $V_o$. In contrast, when the output voltage $V_o$ increases, the base-emitter voltage $V_{BE}$ of the bipolar transistor $T_r$ decreases, decreasing the output current (collector current), and dropping the output voltage $V_o$. The voltage regulator circuit that acts in this manner can maintain its output voltage constant because negative feedback control constantly acts to cancel the output voltage.

Figure 6:
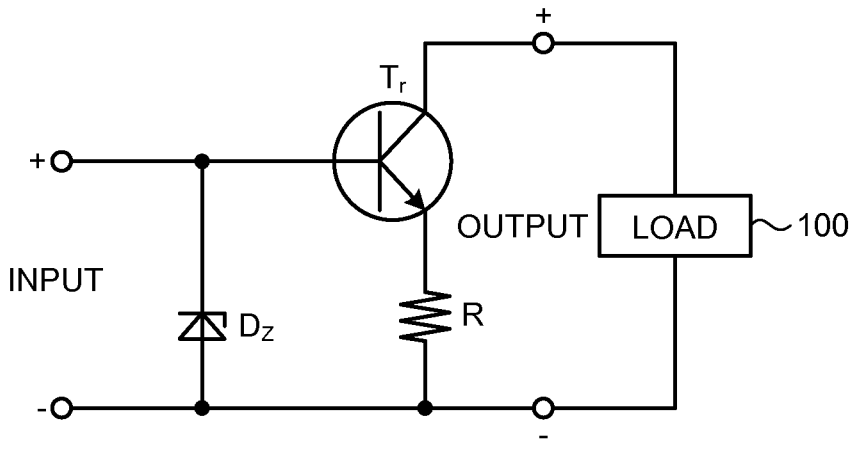
FIG. 6 is a diagram illustrating an example configuration of a circuit that maintains the value of applied electric current constant.

FIG. 6 is a diagram illustrating an example configuration of a constant current regulator circuit (hereinafter, "current regulator circuit") included in the bias applying unit 42. The current regulator circuit illustrated in FIG. 6 includes the bipolar transistor $T_r$, the Zener diode $D_z$, and the resistor R. The positive input terminal of the current regulator circuit is connected to the base of the bipolar transistor $T_r$. The positive output terminal of the current regulator circuit is connected to the collector of the bipolar transistor $T_r$. The Zener diode $D_z$ is connected between the negative input terminal and the positive input terminal of the current regulator circuit. One terminal of the resistor R is connected to the emitter of the bipolar transistor $T_r$; the other terminal is connected to the negative output terminal.

The current regulator circuit included in the bias applying unit 42 can be implemented by connecting the load 100 to the collector of the bipolar transistor $T_r$ as illustrated in FIG. 6. The load 100 in FIG. 6 can be, for instance, the secondary transfer roller 32 illustrated in FIGS. 1 to 4 or the neutralizing unit 38 illustrated in FIG. 4. Referring to FIG. 6, the base-emitter voltage $V_{BE}$ of the bipolar transistor $T_r$ is maintained constant by virtue of the Zener voltage $V_z$ of the Zener diode $D_z$. Consequently, the electric current flowing through the load 100 can be maintained constant. When this current regulator circuit is used, the electric current does not vary even when a voltage across the load varies. As a result, the electric current flowing through the load 100 can be maintained constant.

Figure 7:
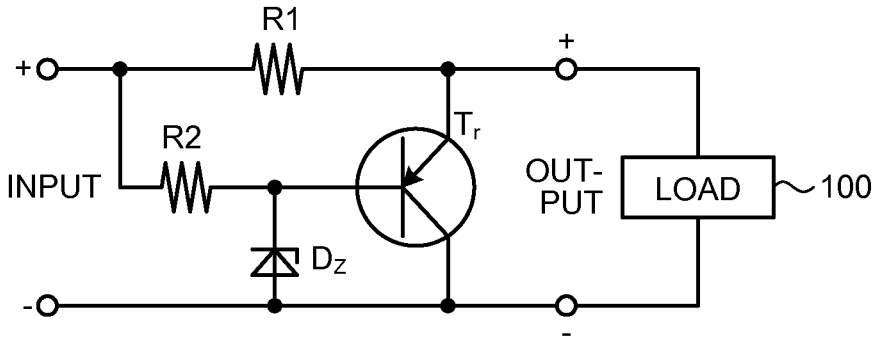
FIG. 7 is a diagram illustrating another example configuration of the circuit that maintains an applied voltage constant.

FIG. 7 is a diagram illustrating another example configuration of the voltage regulator circuit included in the bias applying unit 42. The voltage regulator circuit illustrated in FIG. 7 includes the bipolar transistor $T_r$, the Zener diode $D_z$, a resistor R1, and a resistor R2. One terminal of the resistor R1 is connected to the positive input terminal of the voltage regulator circuit; the other terminal is connected to the emitter of the bipolar transistor $T_r$. The Zener diode $D_z$ and the resistor R2 are connected in series between the negative input terminal and the positive input terminal of the voltage regulator circuit. The base of the bipolar transistor $T_r$ is connected to a junction between the resistor R2 and the Zener diode $D_z$. The positive output terminal of the voltage regulator circuit is connected to the emitter of the bipolar transistor $T_r$; the negative output terminal is connected to the collector of the bipolar transistor $T_r$.

In the voltage regulator circuit illustrated in FIG. 7, a collector-base voltage $V_{CB}$ is maintained constant by virtue of the Zener voltage $V_z$ of the Zener diode $D_z$. The load 100 in FIG. 7 can be, for instance, the intermediate transfer driving roller 20 illustrated in FIGS. 1 to 4. In the voltage regulator circuit illustrated in FIG. 7, when the output voltage increases, a collector-emitter voltage $V_{CE}$ increases. However, because the collector-base voltage $V_{CB}$ is maintained constant by virtue of the Zener diode $D_z$, the base-emitter voltage $V_{BE}$ rises, increasing the collector current. Consequently, the voltage drop across the resistor R1 increases, inhibiting the output voltage from rising. In contrast, when the output voltage decreases, the collector-emitter voltage $V_{CE}$ decreases. However, because the collector-base voltage $V_{CB}$ is maintained constant by virtue of the Zener diode $D_z$, the base-emitter voltage $V_{BE}$ drops, decreasing the collector current. Consequently, the voltage drop across the resistor R1 decreases, inhibiting the output voltage from dropping.

As described above, the voltage regulator circuit illustrated in FIG. 7 can maintain its output voltage constant because feedback control constantly acts to cancel a change in the output voltage.

Figure 8:
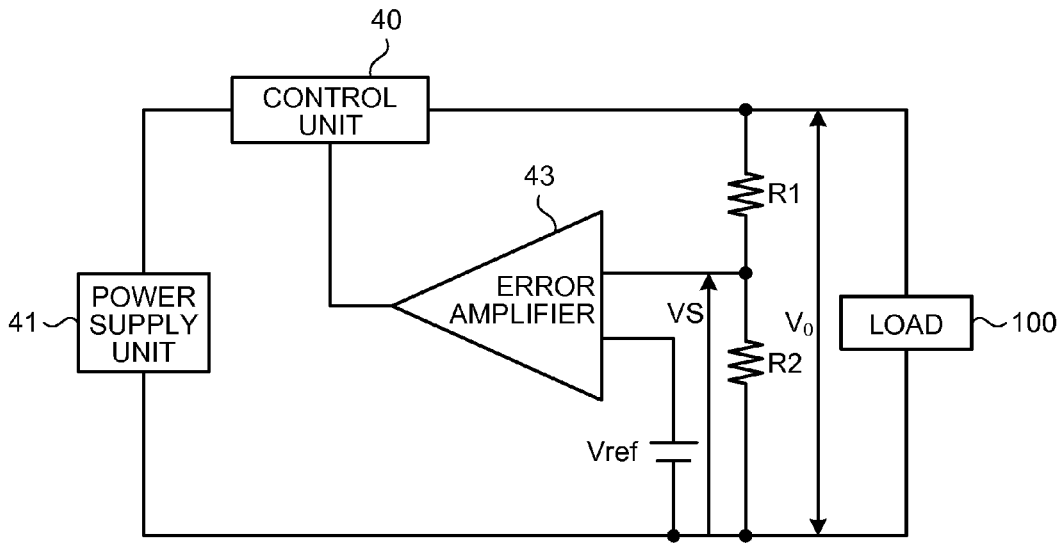
FIG. 8 is a diagram illustrating still another example configuration of the circuit that maintains an applied voltage constant.

FIG. 8 illustrates an example of a voltage regulator circuit, which is included in the bias applying unit 42, that includes a feedback circuit utilizing an error amplifier and maintains a voltage constant by performing feedback control.

The voltage regulator circuit illustrated in FIG. 8 includes an error amplifier 43, the resistor R1, and the resistor R2. The resistor R1 the resistor R2 are connected in series between one terminal and the other terminal of the load 100. One of input terminals of the error amplifier 43 is connected to a junction between the resistor R1 and the resistor R2. A reference voltage $V_{ref}$ is supplied to the other one of the input terminals of the error amplifier 43. An output of the error amplifier 43 is fed to the control unit 40. The control unit 40 that is connected to the power supply unit 41 controls the value of output from the power supply unit 41 according to the output from the error amplifier 43.

The load 100 in FIG. 8 can be, for instance, the intermediate transfer driving roller 20 illustrated in FIGS. 1 to 4. Referring to FIG. 8, the error amplifier 43 compares the reference voltage Vref with a voltage VS, which is obtained by dividing the output voltage $V_o$ using the resistors R1 and R2. The error amplifier 43 feeds back a detected error voltage to the control unit 40. The control unit 40 instructs the power supply unit 41 so as to deliver an output that makes the reference voltage Vref equal to the voltage VS. Thus, the output voltage $V_0$ fed to the load 100 can be maintained constant.

Figure 9:
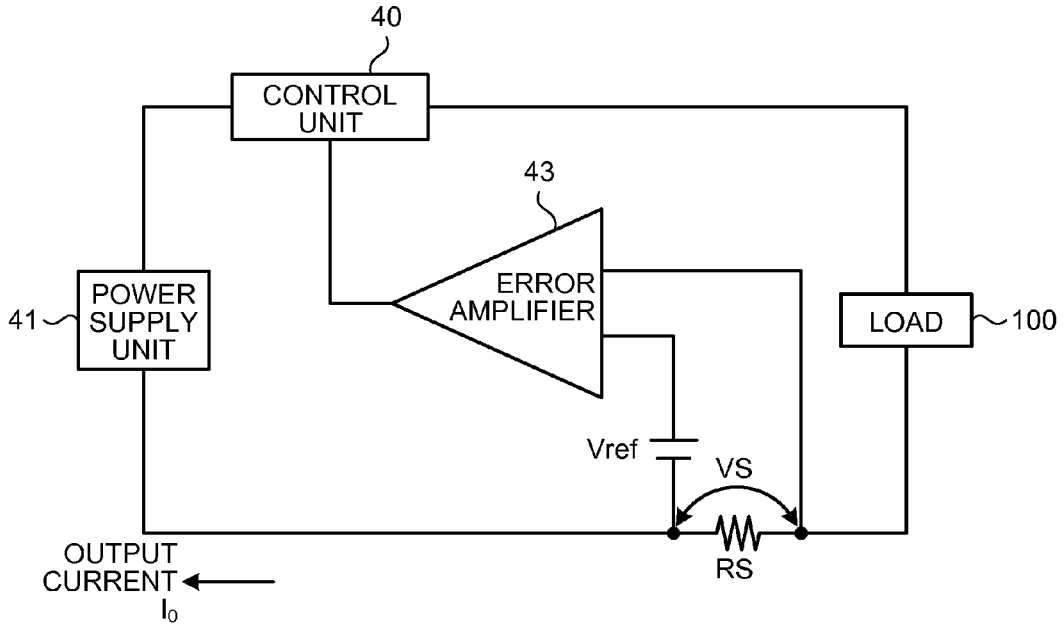
FIG. 9 is a diagram illustrating still another example configuration of the circuit that maintains an applied voltage constant.

FIG. 9 illustrates an example of a current regulator circuit, which is included in the bias applying unit 42, that includes a feedback circuit utilizing the error amplifier 43 and maintains an electric current constant by performing feedback control.

The current regulator circuit illustrated in FIG. 9 includes the error amplifier 43 and a current sensing resistor RS. The control unit 40, the power supply unit 41, and the current sensing resistor RS are connected in series between one terminal and the other terminal of the load 100. One of the input terminals of the error amplifier 43 is connected to a junction between the current sensing resistor RS and the load 100. The reference voltage $V_{ref}$ is supplied to the other one of the input terminals of the error amplifier 43. An output of the error amplifier 43 is fed to the control unit 40. The control unit 40 controls the value of the output from the power supply unit 41 according to the output from the error amplifier 43.

The load 100 in FIG. 9 can be, for instance, the secondary transfer roller 32 illustrated in FIGS. 1 to 4 or the neutralizing unit 38 illustrated in FIG. 4. Referring to FIG. 9, the error amplifier 43 compares the reference voltage $V_{ref}$ with the voltage VS developed across the current sensing resistor RS when an output current $I_0$ flows through the current sensing resistor RS. The error amplifier 43 feeds back a detected error voltage to the control unit 40. The control unit 40 instructs the power supply unit 41 so as to deliver an output that makes the reference voltage $V_{ref}$ equal to the voltage VS. Thus, the value of the output current $I_0$ flowing through the load 100 can be maintained constant.

Employable configuration is not limited to those described above. Another configuration that includes a feedback circuit and performs feedback control can be adopted to maintain the voltage or the electric current can be maintained constant. For example, even in a condition where the power supply unit 41 does not include a circuit for maintaining the electric current constant, an output voltage or a value of output electric current can be maintained constant by providing a feedback circuit that maintains the voltage or the electric current constant externally to the power supply unit 41 and performing feedback control.

Hereinafter, transformers are described by way of examples. For a transformer that handles a high voltage, a large clearance distance and a large creepage distance are required by a dielectric withstand voltage. A sealed-type transformer is a transformer formed in one piece with an output control circuit and sealed with a resin or the like to adapt to a situation where a required clearance distance and a required creepage distance are not provided. A sealed-type transformer achieves solid insulation using a sealing material such as resin. A sealed-type transformer is frequently used when a voltage to be handled is higher than approximately 4 kilovolts (kV). Generally, a sealed-type transformer is normally used when a voltage to be handled is equal to higher than 5 kilovolts (kV).

An open-type transformer is a transformer configured to have an adequate clearance distance and an adequate creepage distance without resorting to solid insulation using a sealing material. Open-type transformers are advantageously more compact and lightweight than sealed-type transformers. Furthermore, open-type transformers formed from less components with less assembly man-hours are less expensive.

As described above, according to an aspect of this embodiment, a first bias lower than a voltage at which discharge from an image carrier to a primary transfer roller will occur is applied to an intermediate transfer driving roller; a second bias that is a voltage opposite in polarity from the first bias and depends on the first bias is applied to a secondary transfer roller. Consequently, discharge of a secondary transfer bias through a medium such as paper can be prevented or reduced. There may preferably be employed the following configuration. That is, a voltage, at which discharge from the intermediate transfer driving roller to the primary transfer roller will not occur, is obtained. A voltage lower than the obtained voltage is applied to the intermediate transfer driving roller. The voltage of one of the first and second biases is maintained constant, and the current of the other one is maintained constant. Thus, the voltage to be applied to the secondary transfer roller can be reduced by the voltage applied to the intermediate transfer driving roller while supplying an amount, or value, of electric current necessary to transfer toner.

Aspects of the present invention are applicable not only to an image forming apparatus such as a copier, a printer, a scanner, or a facsimile but also to a multifunction peripheral having at least two functions of a copier function, a printer function, a scanner function, and a facsimile function.

According to an aspect of the present invention, discharge of a secondary transfer bias through a medium such as paper can be prevented or reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a photosensitive element, on which an electrostatic latent image is to be formed;

an image carrier, onto which a toner image formed by causing toner to stick to the electrostatic latent image is to be transferred;

an intermediate transfer driving roller that drives the image carrier;

a primary transfer roller for transferring the toner image from the photosensitive element to the image carrier;

a secondary transfer roller for performing secondary transfer of transferring the toner image from the image carrier to a medium;

a bias applying unit that applies a secondary transfer bias necessary for the secondary transfer by applying a first bias and a second bias to the intermediate transfer driving roller and the secondary transfer roller, respectively, the first bias being lower than a minimum voltage at which discharge from the image carrier to the primary transfer roller can occur, the second bias being a voltage that is opposite in polarity from the first bias and that depends on the first bias; and a fixing unit that fixes the toner image onto the medium, onto which the toner image has been transferred, wherein the value of the second bias is the difference between the first bias applied to the intermediate transfer driving roller and a voltage to be applied for the secondary transfer.

2. The image forming apparatus according to claim 1, wherein the bias applying unit applies the first voltage that is maintained at a constant voltage to the intermediate transfer driving roller, and the bias applying unit applies the second bias that is maintained at a constant value of electric current to the second transfer roller.

3. The image forming apparatus according to claim 1, further comprising a neutralizing unit neutralizes residual charge on the medium, wherein the bias applying unit applies to the neutralizing unit a same bias as the first bias applied to the intermediate transfer driving roller.

4. The image forming apparatus according to claim 1, wherein the bias applying unit includes open-type transformers as transformers that output the first bias and the second bias to the intermediate transfer driving roller and the secondary transfer roller, respectively.

5. An image forming method comprising:

forming an electrostatic latent image on a photosensitive element;

forming a toner image formed by causing toner to stick to the electrostatic latent image;

transferring the toner image from the photosensitive element to the image carrier using a primary transfer roller;

applying a secondary transfer bias necessary for secondary transfer by applying a first bias and a second bias to an intermediate transfer driving roller and a secondary transfer roller, respectively, the first bias being lower than a minimum voltage at which discharge from the image carrier to the primary transfer roller can occur, the second bias being a voltage that is opposite in polarity from the first bias and that depends on the first bias; and performing the secondary transfer of transferring the toner image from the photosensitive element to the image carrier using the secondary transfer roller, wherein applying the secondary transfer bias necessary for secondary transfer includes determining a value of the second bias by subtracting the first bias applied to the intermediate transfer driving roller from a voltage that needs to be applied for the secondary transfer.

* * * * *